US011046075B2

(12) United States Patent
Murayama et al.

(10) Patent No.: US 11,046,075 B2
(45) Date of Patent: Jun. 29, 2021

(54) LIQUID EJECTING HEAD AND LIQUID EJECTING APPARATUS

(71) Applicant: SEIKO EPSON CORPORATION, Tokyo (JP)

(72) Inventors: Toshiro Murayama, Fujimi-machi (JP); Shunsuke Watanabe, Matsumoto (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/800,475

(22) Filed: Feb. 25, 2020

(65) Prior Publication Data

US 2020/0269577 A1 Aug. 27, 2020

(30) Foreign Application Priority Data

Feb. 27, 2019 (JP) ..... JP2019-034129

(51) Int. Cl.
*B41J 2/14* (2006.01)

(52) U.S. Cl.
CPC ..... *B41J 2/14145* (2013.01); *B41J 2/14201* (2013.01); *B41J 2002/14419* (2013.01)

(58) Field of Classification Search
CPC ..... B41J 2/14145; B41J 2/14201; B41J 2002/14419; B41J 2002/14241; B41J 2202/07; B41J 2202/12; B41J 2/14233
See application file for complete search history.

(56) References Cited

U.S. PATENT DOCUMENTS 8,757,782 B2 * 6/2014 Watanabe ..... B41J 2/14233 347/84
2012/0176450 A1 7/2012 Akahane et al.

FOREIGN PATENT DOCUMENTS

JP 2012-143948 8/2012

OTHER PUBLICATIONS

IP.com search (Year: 2021).*

* cited by examiner

*Primary Examiner* — Lisa Solomon
(74) *Attorney, Agent, or Firm* — Workman Nydegger

(57) ABSTRACT

The flow channel forming substrate has a partition wall which is disposed between two of the outlet flow channels adjacent to each other and which partitions the outlet flow channel.

8 Claims, 8 Drawing Sheets

LIQUID EJECTING HEAD AND LIQUID EJECTING APPARATUS

The present application is based on, and claims priority from JP Application Serial Number 2019-034129, filed Feb. 27, 2019, the disclosure of which is hereby incorporated by reference herein in its entirety.

BACKGROUND

1. Technical Field

The present disclosure relates to a liquid ejecting head and a liquid ejecting apparatus.

2. Related Art

In the related art, an ink jet recording apparatus including a liquid ejecting head is known (for example, JP-A-2012-143948). In this ink jet recording apparatus, the liquid ejecting head includes a plurality of communication passages having pressure generation chambers, a common liquid chamber and a circulation flow channel as a common liquid chamber, which communicate in common with the plurality of communication passages, and a circulation communication passage through which corresponding one of the communication passages and the circulation flow channel communicate with each other for each communication passage.

In the liquid ejecting head according to the related art, when a coupling port between the circulation communication passage and the circulation flow channel is changed to face a direction intersecting the nozzle plate, bubbles heading from the circulation communication passage to the circulation flow channel tend to move in the intersecting direction by a buoyant force. Thus, the bubbles may be caught at the coupling portion between the circulation communication passage and the circulation flow channel. When the bubbles are caught at the coupling portion, the bubbles may stay in the coupling portion.

SUMMARY

According to an aspect of the present disclosure, a liquid ejecting head is provided. This liquid ejecting head includes: a nozzle plate provided with a nozzle for ejecting a liquid; a flow channel forming substrate which is stacked on the nozzle plate and has a plurality of individual flow channels each including a pressure chamber communicating with the nozzle and arranged in an arrangement direction that is one of in-plane directions of the nozzle plate, a first common liquid chamber coupled to the plurality of individual flow channels, and a second common liquid chamber coupled to the plurality of individual flow channels and coupled to the first common liquid chamber via the plurality of individual flow channels; and a pressure generating element that causes a pressure change in the liquid in the pressure chamber, in which in a vertical direction perpendicular to an in-plane direction of the nozzle plate, when a side of the flow channel forming substrate with respect to the nozzle plate is set as one side and a side of the nozzle plate with respect to the flow channel forming substrate is set as another side, each of the plurality of individual flow channels has an outlet flow channel coupled to the second common liquid chamber and extending in the in-plane direction and a coupling flow channel having a coupling port coupled to the outlet flow channel, the coupling flow channel extends from the one side to the other side toward the coupling port, the outlet flow channel has an outlet portion through which the liquid flows into the second common liquid chamber and which faces the in-plane direction, the second common liquid chamber has an introduction flow channel which is coupled to the outlet portion and through which the liquid flows along the in-plane direction, and the flow channel forming substrate has a partition wall which is disposed between two of the outlet flow channels adjacent to each other and which partitions the outlet flow channel.

DESCRIPTION OF EXEMPLARY EMBODIMENTS

A. First Embodiment

Figure 1:
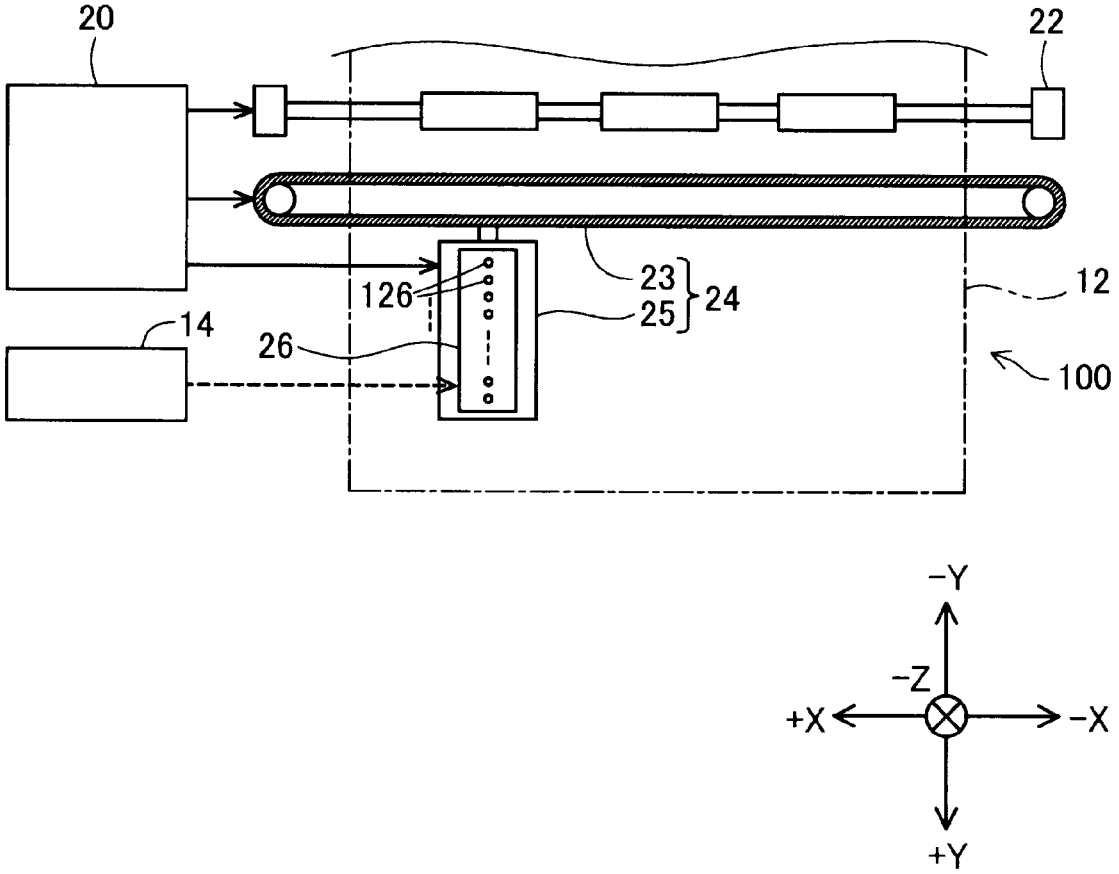
FIG. 1 is a diagram schematically illustrating a configuration of a liquid ejecting apparatus according to an embodiment of the present disclosure.

FIG. 1 is a diagram schematically illustrating a configuration of a liquid ejecting apparatus 100 according to an embodiment of the present disclosure. The liquid ejecting apparatus 100 is an ink jet printing apparatus that ejects an ink, which is an example of a liquid, onto a medium 12. The medium 12 is a printing target made of any material such as a resin film and a cloth in addition to a printing paper sheet, and the liquid ejecting apparatus 100 performs printing on such various types of media 12. In an X direction, a Y direction, and a Z direction perpendicular to each other, in each of the drawings, a main scanning direction that is a movement direction of a liquid ejecting head 26, which will be described below, is set as the X direction, a sub scanning direction that is a medium feeding direction perpendicular to the main scanning direction is set as the Y direction, and an ink ejecting direction is set as the Z direction. Further, when a direction is specified, a positive direction is set as "+" and a negative direction is set as "−". In this case, both positive and negative signs are used to indicate the direction. The liquid ejecting head 26 may not move in the X direction or the liquid ejecting head 26 may move relative to the medium 12 in the Y direction.

The liquid ejecting apparatus 100 includes a liquid storage container 14, a transport mechanism 22 that sends out the medium 12, a control unit 20, a head movement mechanism 24, and the liquid ejecting head 26. The liquid storage container 14 stores a liquid supplied to the liquid ejecting head 26. A bag-like ink pack formed of a flexible film, an ink tank that can be refilled with the ink or the like can be used as the liquid storage container 14. The control unit 20 includes a processing circuit such as a central processing unit (CPU) and a storage circuit such as a semiconductor memory, and comprehensively controls the transport mechanism 22, the head movement mechanism 24, the liquid ejecting head 26, and the like. The transport mechanism 22 is operated under a control of the control unit 20, and sends out the medium 12 in the +Y direction.

The head movement mechanism 24 includes a transport belt 23 wound in the X direction over a printing range of the medium 12 and a carriage 25 in which the liquid ejecting head 26 is accommodated and which is fixed to the transport belt 23. The head movement mechanism 24 is operated under the control of the control unit 20, and causes the carriage 25 to reciprocate in the X direction that is the main scanning direction of the liquid ejecting head 26. When the carriage 25 reciprocates, the carriage 25 is guided by a guide rail that is not illustrated. The liquid ejecting head 26 has a plurality of nozzles 126 arranged in the Y direction that is the sub scanning direction. A head configuration in which a plurality of the liquid ejecting heads 26 are mounted on the carriage 25 or a head configuration in which the liquid storage container 14 together with the liquid ejecting head 26 is mounted on the carriage 25 may be employed.

Figure 2:
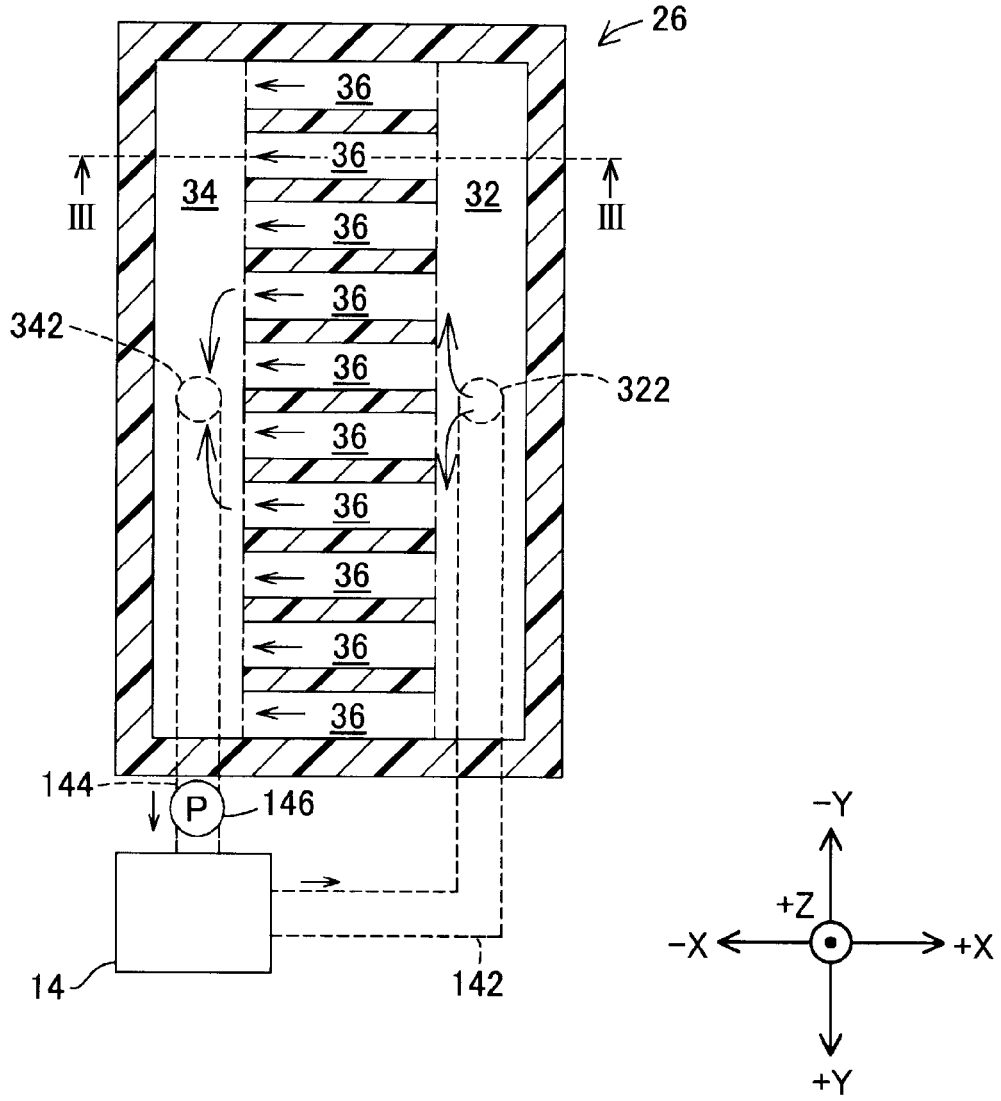
FIG. 2 is a schematic sectional view of a liquid ejecting head in an XY plane.

FIG. 2 is a schematic sectional view of the liquid ejecting head 26 in an XY plane. The liquid ejecting head 26 includes a flow channel formation substrate in which a plurality of individual flow channels 36, one first common liquid chamber 32, and one second common liquid chamber 34 are formed. The first common liquid chamber 32 and the second common liquid chamber 34 are coupled to communicate with each other via the plurality of individual flow channels 36.

The liquid storage container 14 and the liquid ejecting head 26 are coupled to each other via a supply flow channel 142 and a recovery flow channel 144 in a state in which the liquid can circulate. The supply flow channel 142 is coupled to a supply port 322 formed in the first common liquid chamber 32 of the liquid ejecting head 26. The recovery flow channel 144 is coupled to a discharge port 342 formed in the second common liquid chamber 34 of the liquid ejecting head 26. The recovery flow channel 144 is provided with a pump 146. The pump 146 sends out the liquid from the liquid ejecting head 26 side to the liquid storage container 14 side, and causes the liquid to circulate between the liquid ejecting head 26 and the liquid storage container 14. The supply flow channel 142 may be provided with a pump. Further, the number of each of the first common liquid chamber 32 and the second common liquid chamber 34 is not limited to one. For example, the number of at least one of the first common liquid chamber 32 and the second common liquid chamber 34 may be two or more.

The liquid in the liquid ejecting head 26 circulates through the following path. The liquid supplied from the liquid storage container 14 via the supply flow channel 142 first flows into the first common liquid chamber 32. The liquid that has flowed into the first common liquid chamber 32 flows into each of the plurality of individual flow channels 36 coupled to the first common liquid chamber 32. The liquid that has flowed into the plurality of individual flow channels 36 flows into the second common liquid chamber 34 that is commonly coupled to the plurality of individual flow channels 36. The liquid in the second common liquid chamber 34 is recovered into the liquid storage container 14 via the recovery flow channel 144. The liquid recovered in the liquid storage container 14 is supplied to the liquid ejecting head 26 via the supply flow channel 142 again.

Figure 3:
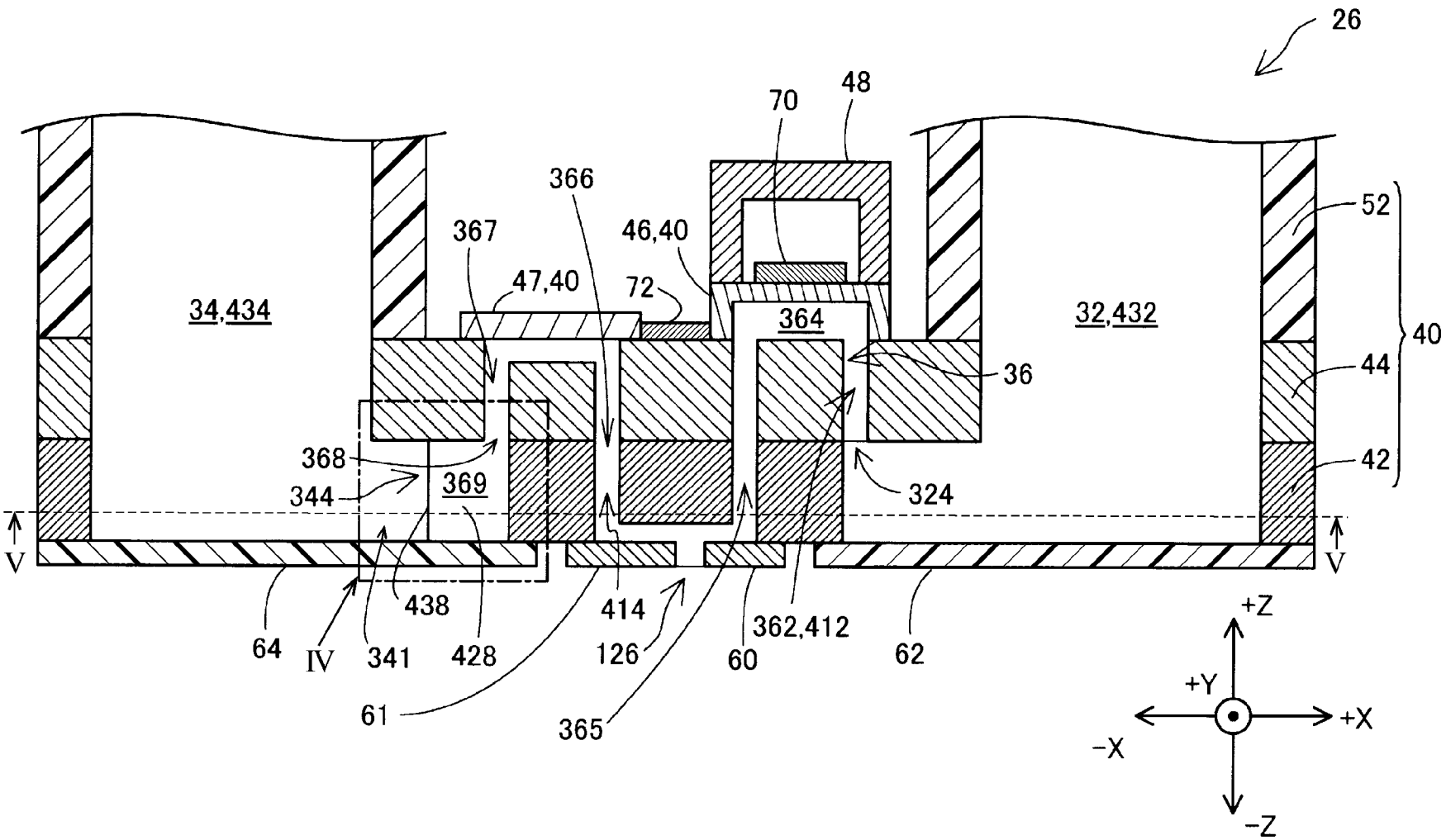
FIG. 3 is a schematic sectional view of the liquid ejecting head, which is taken along line III-III of FIG. 2.

FIG. 3 is a schematic sectional view of the liquid ejecting head 26, which is taken along line III-III of FIG. 2. As described above, the liquid ejecting head 26 includes, as a flow channel structure, the first common liquid chamber 32, the second common liquid chamber 34, and the individual flow channels 36. In FIG. 3, although only one individual flow channel 36 is illustrated, the plurality of individual flow channels 36 are arranged in the Y direction that is a depth direction of the figure. Further, the first common liquid chamber 32 and the second common liquid chamber 34 are commonly coupled to the plurality of individual flow channels 36. Therefore, the depth of the first common liquid chamber 32 and the second common liquid chamber 34, that is the dimension in the Y direction in FIG. 3, is larger than the depth of each individual flow channel 36.

The first common liquid chamber 32 has a larger dimension in the Z direction, which is a direction perpendicular to a nozzle surface 61, than that of the individual flow channel 36. The nozzle surface 61 is a wall surface, at which the nozzles 126 are formed, among the outer wall surfaces of the liquid ejecting head 26. The first common liquid chamber 32 has an inlet portion 324 through which the liquid flows from the first common liquid chamber 32 into the individual flow channel 36. The inlet portion 324 is provided at a position facing the bottom surface of the first common liquid chamber 32. A plurality of the inlet portions 324 are provided in the Y direction as an arrangement direction. Each of the plurality of inlet portions 324 has an opening facing the −Z direction. In the present embodiment, the supply port 322 coupled to the supply flow channel 142 illustrated in FIG. 2 is formed at the top surface of the first common liquid chamber 32, which is not illustrated. Further, the individual flow channel 36 may have a larger dimension in the Z direction than that of the first common liquid chamber 32.

Each of the plurality of individual flow channels 36 has a pressure chamber 364, a first flow channel 362, a second flow channel 365, a third flow channel 366, a coupling flow channel 367, and an outlet flow channel 369. The plurality of individual flow channels 36 communicate with the nozzles 126 having openings for ejecting the liquid in a flow channel downstream of the pressure chamber 364. The pressure chamber 364 has a space for applying a pressure to the liquid in the individual flow channel 36. A part of the liquid to which the pressure is applied is ejected from the nozzle 126. Further, a part of the liquid that has not been ejected from the nozzle 126 may move to the first common liquid chamber 32 and the second common liquid chamber 34 coupled by the individual flow channel 36. At this time, vibration generated in the pressure chamber 364 when the pressure is applied propagates, as residual vibration, to the first common liquid chamber 32 and the second common liquid chamber 34 at the inflow of the liquid. Accordingly, residual vibration generated in the individual flow channel 36 by itself is reduced.

The first flow channel 362 is a flow channel that couples the inlet portion 324 provided in the first common liquid chamber 32 and the pressure chamber 364, and a flow channel extending from the inlet portion 324 toward the pressure chamber 364 in the +Z direction. The second flow channel 365 is a flow channel from the pressure chamber 364 to the nozzle 126, and has a flow channel extending from the pressure chamber 364 in the −Z direction and a flow channel extending from a downstream end of the flow channel extending from the pressure chamber 364 in the −Z direction toward the nozzle 126 in the −X direction. The third flow channel 366 is a flow channel from the nozzle 126 to the coupling flow channel 367. The third flow channel 366 has a flow channel extending from the nozzle 126 in the −X direction, a flow channel extending in the +Z direction from a downstream end of the flow channel extending in the −X direction, and a flow channel extending from a downstream end of the flow channel extending in the +Z direction toward the coupling flow channel 367 in the −X direction.

The coupling flow channel 367 is a flow channel extending from a downstream end of the third flow channel 366 toward the outlet flow channel 369 in the −Z direction. The coupling flow channel 367 has a coupling port 368 which is coupled to the outlet flow channel 369 and through which the liquid in the coupling flow channel 367 flows into the outlet flow channel 369. An opening of the coupling port 368 faces the −Z direction which is a direction perpendicular to the in-plane direction of a nozzle plate 60.

The outlet flow channel 369 is a flow channel coupled to the second common liquid chamber 34 and extending from the coupling port 368 toward the second common liquid chamber 34 in the −X direction. The outlet flow channel 369 has an outlet portion 344 through which the liquid in the outlet flow channel 369 flows into the second common liquid chamber 34.

The outlet portion 344 is formed at one (side surface 438) of the side surfaces of the second common liquid chamber 34 on a side where the first common liquid chamber 32 is provided. A plurality of the outlet portions 344 are provided in the Y direction. Opening of the outlet portion 344 is a direction along the in-plane direction of the nozzle surface 61, and faces the −X direction perpendicular to the Y direction that is an arrangement direction of the individual flow channels 36.

Similar to the first common liquid chamber 32, the second common liquid chamber 34 has a larger dimension in the Z direction, which is a direction perpendicular to the nozzle surface 61, than that of the individual flow channel 36. In the present embodiment, the discharge port 342 coupled to the recovery flow channel 144 illustrated in FIG. 2 is formed at the top surface of the second common liquid chamber 34, which is not illustrated. Further, the individual flow channel 36 may have a larger dimension in the Z direction than that of the second common liquid chamber 34.

Hereinafter, a member constituting the liquid ejecting head 26 will be described. The liquid ejecting head 26 includes, as a member forming a flow channel structure, a flow channel forming substrate 40, the nozzle plate 60, a first film 62, and a second film 64. The flow channel forming substrate 40 is formed by a first communication plate 42, a second communication plate 44, a pressure chamber forming substrate 46, a sealing member 47, and a case 52. Each of the first communication plate 42, the second communication plate 44, the pressure chamber forming substrate 46, the sealing member 47, and the nozzle plate 60 is formed of a silicon single crystal plate. On the other hand, the case 52 is formed of a resin molded product such as plastic. In the liquid ejecting head 26, the nozzle plate 60, the first communication plate 42, the second communication plate 44, and the case 52 are stacked in the order thereof from the −Z direction to the +Z direction. Further, the nozzle plate 60, the first communication plate 42, the second communication plate 44, and the pressure chamber forming substrate 46 are stacked in the order thereof from the −Z direction to the +Z direction. That is, a direction from the nozzle plate 60 toward the flow channel forming substrate 40 is the +Z direction, and a direction from the flow channel forming substrate 40 toward the nozzle plate 60 is the −Z direction. The first communication plate 42 and the second communication plate 44 are plate-like members extending in the XY plane, respectively. The flow channel forming substrate 40 and the nozzle plate 60 may be formed of a material other than a silicon single crystal plate or a resin, for example, any of various materials such as metal and glass.

The flow channel forming substrate 40 forms the first common liquid chamber 32, the second common liquid chamber 34, and the plurality of individual flow channels 36. In detail, a first opening portion 432 formed by the first communication plate 42, the second communication plate 44, and the case 52 in the flow channel forming substrate 40 forms the first common liquid chamber 32. In detail, a second opening portion 434 formed by the first communication plate 42, the second communication plate 44, and the case 52 in the flow channel forming substrate 40 forms the second common liquid chamber 34. Each of the first opening portion 432 and the second opening portion 434 is open in the −Z direction. The first opening portion 432 and the second opening portion 434 are formed side by side in the X direction with a region forming the individual flow channel 36 in between. The individual flow channel 36 is formed by the first communication plate 42, the second communication plate 44, the pressure chamber forming substrate 46, and the sealing member 47 in the flow channel forming substrate 40. The first communication plate 42 in the flow channel forming substrate 40 has a partition wall 428 that partitions a plurality of the outlet flow channels 369. The pressure chamber 364 in the individual flow channel 36 is formed by the pressure chamber forming substrate 46.

The first film 62 is attached to the flow channel forming substrate 40 from the −Z direction side to cover the first opening portion 432 that forms the first common liquid chamber 32. The first film 62 defines an internal space of the first common liquid chamber 32 together with the first opening portion 432. The first film 62 is a film member formed of a flexible resin. The first film 62 may be formed of a material other than resin, for example, any of various materials such as thin film metal.

The second film 64 is attached to the flow channel forming substrate 40 from the −Z direction side to cover the second opening portion 434 that forms the second common liquid chamber 34. The second film 64 defines an internal space of the second common liquid chamber 34 together with the second opening portion 434. Similar to the first film 62, the second film 64 is a film member formed of a flexible resin. The second film 64 may be formed of a material other than resin, for example, any of various materials such as thin film metal.

The bottom surface of the first common liquid chamber 32 is defined by the first film 62. Further, the bottom surface of the second common liquid chamber 34 is defined by the second film 64. The compliance of the first common liquid chamber 32 and the second common liquid chamber 34 are improved by the flexibility of the first film 62 and the second film 64. Therefore, the occurrence of crosstalk in which the pressure fluctuation generated in one pressure chamber 364 is propagated to another pressure chamber 364 via the first common liquid chamber 32 or the second common liquid chamber 34 is suppressed.

The first film 62 and the second film 64 are fixed by being bonded to the flow channel forming substrate 40 using an adhesive. The first film 62 is bonded to the −Z side end surface of the first communication plate 42 located at an outer edge of the first opening portion 432. Further, the second film 64 is bonded to the −Z side end surface of the first communication plate 42 located at an outer edge of the second opening portion 434. In the present embodiment, the second film 64 is not bonded to the partition wall 428 in the outlet flow channel 369.

When viewed from the Z direction, the nozzle plate 60 is affixed to the flow channel forming substrate 40 from the −Z direction side at a position that overlaps a region of the flow channel forming substrate 40 where the individual flow channels 36 are formed. The nozzle plate 60 has nozzle openings that form the nozzles 126. The nozzle plate 60 defines the nozzle surface 61 of the liquid ejecting head 26. In the present embodiment, the nozzle surface 61 extends along a direction perpendicular to the Z direction, that is, the XY plane. The nozzle plate 60 may be formed of a material other than the silicon single crystal plate, for example, any of various materials such as metal and resin. For example, the nozzle plate 60 may be formed of a flexible resin.

A pressure generating element 70 for causing a pressure change in the liquid in the pressure chamber 364 is disposed on the +Z direction side of the pressure chamber forming substrate 46 while being covered with a protective substrate 48. In the present embodiment, a piezoelectric element is used as the pressure generating element 70. The pressure generating element 70 is electrically coupled to an electrode 72 disposed at a position overlapping the individual flow channel 36 in the Z direction. In the present embodiment, the liquid ejecting apparatus 100 is a piezo ink jet printer in which a piezoelectric element is employed as a pressure generating element. However, the present disclosure is not limited thereto. For example, the liquid ejecting apparatus 100 may be a thermal ink jet printer that includes, instead of the piezoelectric element, the pressure generating element that changes the pressure in the pressure chamber 364 by heating the liquid in the pressure chamber 364.

The flow channel forming substrate 40 has a first through-hole 412 and a second through-hole 414 in addition to openings of the first opening portion 432 and the second opening portion 434. The first through-hole 412 is an opening that forms the first flow channel 362 that is a flow channel of the individual flow channel 36 between the first common liquid chamber 32 and the pressure chamber 364. The second through-hole 414 is an opening that forms a part of the third flow channel 366 that is a flow channel of the individual flow channel 36 between the second common liquid chamber 34 and the pressure chamber 364. In detail, the second through-hole 414 forms a flow channel extending in the Z direction among the third flow channel 366.

The cross-sectional area of the first through-hole 412 is smaller than the cross-sectional area of the second through-hole 414. Therefore, the liquid is less likely to flow in the first flow channel 362 formed by the first through-hole 412 than in the third flow channel 366 formed by the second through-hole 414. Accordingly, the pressure fluctuation in the pressure chamber 364 is efficiently propagated to the nozzle 126 coupled to the individual flow channel 36 between the pressure chamber 364 and the third flow channel 366. Therefore, the liquid can be efficiently ejected from the nozzle 126. Although the cross-sectional area of the first through-hole 412 is smaller than the cross-sectional area of the second through-hole 414, the present disclosure is not limited thereto. The cross-sectional area of the first through-hole 412 may be equal to or larger than the cross-sectional area of the second through-hole 414. Further, the second through-hole 414 may form a flow channel of the coupling flow channel 367, which extends in the −Z direction.

In the individual flow channel 36, the flow channel resistance of a flow channel between the first common liquid chamber 32 and the nozzle 126 is the same as the flow channel resistance of a flow channel between the second common liquid chamber 34 and the nozzle 126. In detail, the flow channel between the first common liquid chamber 32 and the nozzle 126 is a series of flow channels including the first flow channel 362, the pressure chamber 364, and the second flow channel 365. In detail, the flow channel between the second common liquid chamber 34 and the nozzle 126 is a series of flow channels including the third flow channel 366, the coupling flow channel 367, and the outlet flow channel 369. In this case, the pressure difference between the first common liquid chamber 32 and the second common liquid chamber 34 can be reduced. Accordingly, adjustment of a meniscus position of the nozzle 126 is facilitated. A case where the flow channel resistances are the same includes not only a case where the flow channel resistances are exactly the same but also a case where the flow channel resistances can be regarded as the same in design. In detail, the difference is preferably within 50%, and is more preferably within 10%.

Hereinafter, distribution channel of bubbles in the liquid ejecting head 26 will be described. For example, when the liquid ejecting head 26 is initially filled with the liquid, when the bubbles existing in the liquid storage container 14 flows inward, or when bubbles flow inward from the nozzle 126, the bubbles may flow into the liquid ejecting head 26. The liquid that has flowed into the first common liquid chamber 32 flows into the individual flow channel 36. Since the individual flow channel 36 is suctioned by the pump illustrated in FIG. 2, and thus the pressure of the individual flow channel 36 is smaller than the pressure of the first common liquid chamber 32, the bubbles easily flow into the individual flow channel 36. Therefore, staying of the bubbles in the first common liquid chamber 32 near the inlet portion 324 is suppressed. Accordingly, inhibition of inflow of the liquid from the first common liquid chamber 32 to the individual flow channel 36 by the bubbles is suppressed.

The bubbles that have flowed into the individual flow channel 36 from the first common liquid chamber 32 flow into the second common liquid chamber 34. The individual flow channel 36 has a smaller flow-channel cross-sectional area than that of the first common liquid chamber 32 and the second common liquid chamber 34. Therefore, since a flow rate of the liquid is high in the individual flow channel 36, particularly, in a section from the inlet portion 324 to the coupling port 368, the bubbles move smoothly. The bubbles that have flowed into the second common liquid chamber 34 pass through an introduction flow channel 341 to move to the recovery flow channel 144 illustrated in FIG. 2. The introduction flow channel 341 is a flow channel which is coupled to the outlet portion 344 of the second common liquid chamber 34 and through which the liquid flows in the −X direction. The bubbles that have moved to the recovery flow channel 144 flow out to the liquid storage container 14. The liquid ejecting head 26 may not cause the bubbles that have flowed into the liquid ejecting head 26 to flow out to the liquid storage container 14. For example, the liquid ejecting head 26 may include a configuration for removing the bubbles, for example, a filter that catches the bubbles and a deaeration mechanism for deaeration in the flow channel such as the first common liquid chamber 32. Thus, the bubbles may be removed from the liquid ejecting head 26 without flowing into the liquid storage container 14.

Figure 4:
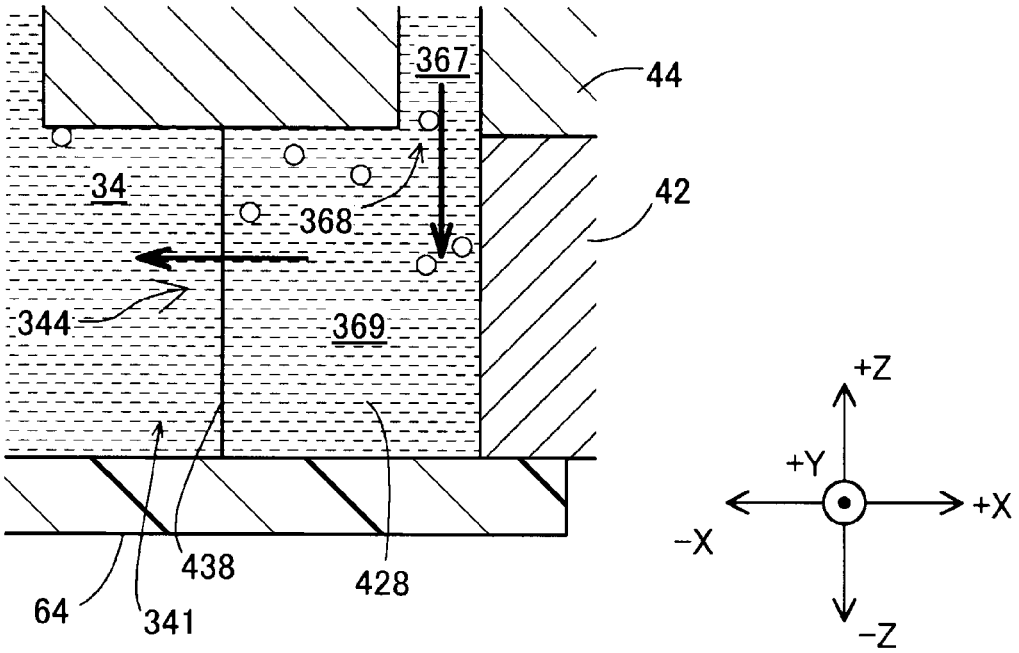
FIG. 4 is an enlarged view of a region indicated by a one-dot chain line in FIG. 3.

FIG. 4 is an enlarged view of a region indicated by a one-dot chain line IV in FIG. 3. When the bubbles flow into the outlet flow channel 369 from the coupling port 368 through the coupling flow channel 367, the movement direction of the bubbles is the −Z direction that is an opening direction of the coupling port 368. A buoyant force in the +Z direction and a force in the −X direction received from the liquid flowing through the outlet flow channel 369 are applied to the bubbles that have flowed into the outlet flow channel 369 from the coupling port 368. Accordingly, as indicated by the arrow, the movement direction of the bubbles in the outlet flow channel 369 is changed from the −Z direction that is the opening direction of the coupling port 368 to the −X direction that is a flow direction of the liquid.

Figure 5:
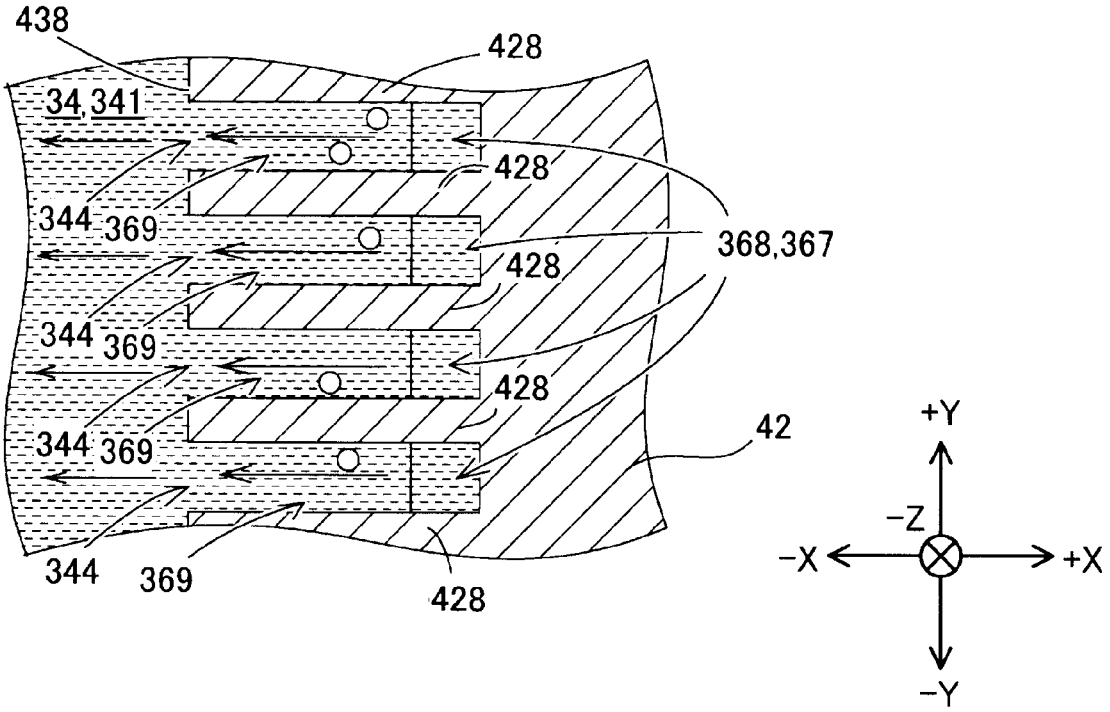
FIG. 5 is a partial schematic view, which is taken along line V-V of FIG. 3.

FIG. 5 is a partial schematic view, which is taken along line V-V of FIG. 3. The partition walls 428 are provided with every part between the two adjacent coupling ports 368. Accordingly, the outlet flow channel 369 is provided at each coupling port 368, and one outlet flow channel 369 is provided at one coupling port 368. Therefore, an interval between the two adjacent partition walls 428 in the Y direction is smaller than the width of the second common liquid chamber 34 in the Y direction. Therefore, the flow rate of the liquid in the outlet flow channel 369 is larger than the flow rate of the liquid in the second common liquid chamber 34. Further, each of the plurality of partition walls 428 extends from the coupling port 368 toward the second common liquid chamber 34 in the −X direction.

The bubbles flow from the +Z direction to the −Z direction through the coupling flow channel 367, and then flow from the +X direction to the −X direction through the outlet flow channel 369. That is, in the outlet flow channel 369, the movement direction of the bubbles flowing from the coupling flow channel 367 to the second common liquid chamber 34 is changed from the flow in the Z direction to the flow in the X direction. In the outlet flow channel 369, since the flow-channel cross-sectional area is reduced by the partition wall 428, the flow rate is large. Therefore, a force applied to the bubbles in the −X direction in the outlet flow channel 369 illustrated in FIG. 4 is large. Accordingly, the above-described movement direction of the bubbles is smoothly changed. Accordingly, changing of the movement direction of the bubbles that have flowed into the outlet flow channel 369 can suppress staying of the bubbles near the coupling port 368.

Further, as illustrated in FIG. 5, the flow channel direction of the outlet flow channel 369 and the opening direction of the outlet portion 344 defined by the outlet flow channel 369 coincide with the communication direction of the liquid in the introduction flow channel 341 of the second common liquid chamber 34. Therefore, the bubbles moved from the outlet portion 344 to the second common liquid chamber 34 move in the −X direction together with the liquid without greatly changing the movement direction. Therefore, the movement of the bubbles flowing into the second common liquid chamber 34 from the outlet portion 344 is smooth.

According to the above-described first embodiment, a difference between a direction in which the liquid flows in the second common liquid chamber 34 and a direction of the outlet portion 344 can be reduced. Further, as the partition wall 428 that partitions the outlet flow channel 369 is provided, the flow-channel cross-sectional area of the outlet flow channel 369 is smaller than that when the partition wall 428 is not provided. Accordingly, the flow rate of the liquid in the outlet flow channel 369 increases. Therefore, when the bubbles together with the liquid flow between the individual flow channel 36 and the second common liquid chamber 34, the bubbles that have flowed into the outlet flow channel 369 from the coupling port 368 move smoothly. Therefore, occurrence of catching of the bubbles in the coupling port 368 can be suppressed. Accordingly, ejection failure of the nozzle 126 due to obstruction of the flow of the liquid in the individual flow channel 36 due to the bubbles caught in the coupling port 368 is suppressed.

B. Second Embodiment

Figure 6:
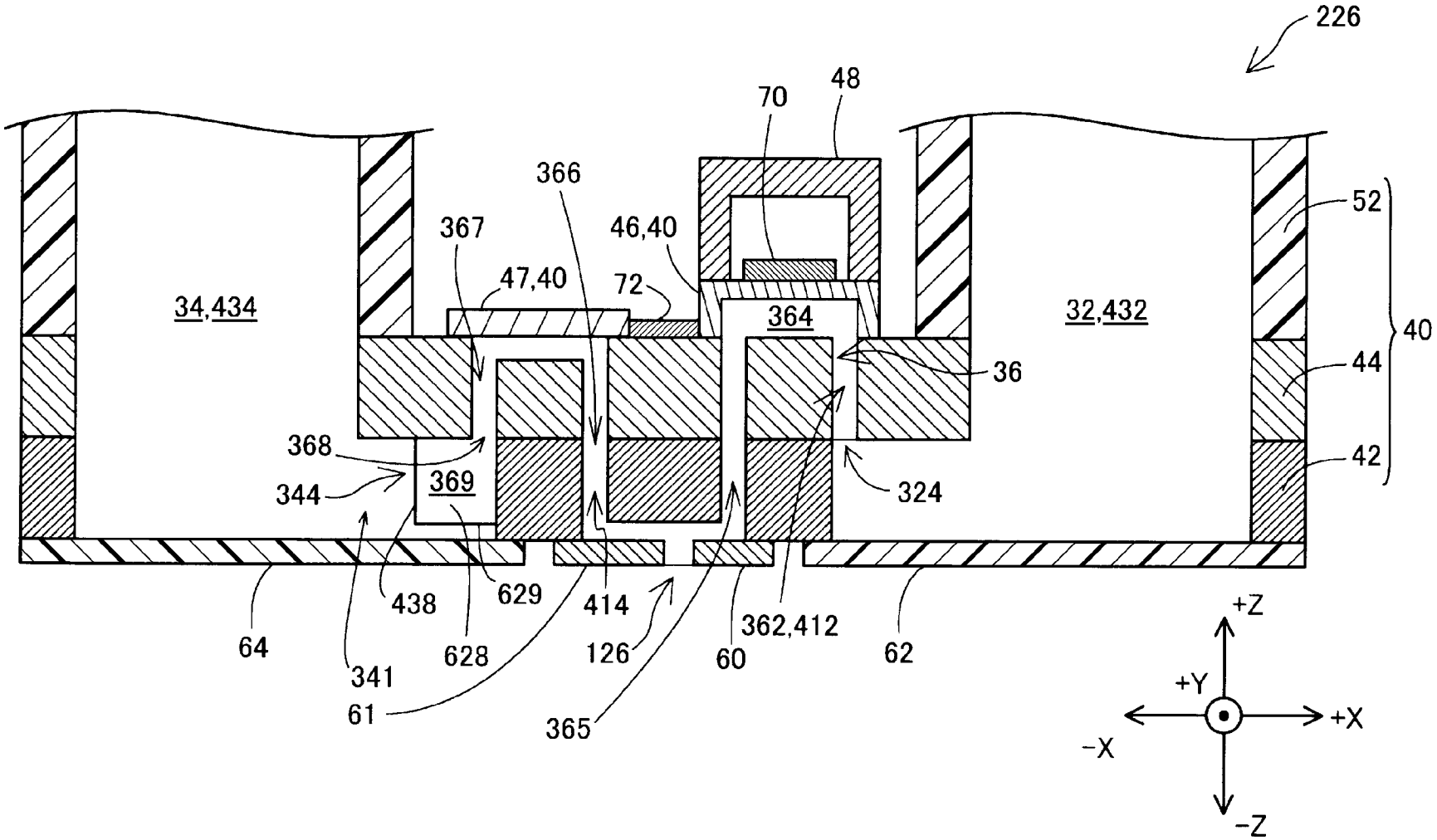
FIG. 6 is a schematic sectional view of a liquid ejecting head according to a second embodiment.

FIG. 6 is a schematic sectional view of a liquid ejecting head 226 according to a second embodiment. The liquid ejecting head 226 according to the second embodiment is different from the liquid ejecting head 26 according to the first embodiment in terms of a structure of a partition wall 628 that forms the outlet flow channel 369. Hereinafter, the same configurations as those according to the first embodiment are designated by the same reference numerals, and detailed description thereof will be omitted.

A plurality of the partition walls 628 and the second film 64 are separated from each other. In detail, in the Z direction, a gap is formed between the second film 64 and a bottom surface 629 on the −Z side among the wall surfaces of the partition wall 628. Accordingly, when the flow channel forming substrate 40 and the second film 64 are bonded to each other using an adhesive, flow of the adhesive to the partition wall 628 side is suppressed. Therefore, bonding between the partition wall 628 and the second film 64 is suppressed. Accordingly, a reduction in a movable range of the second film 64 by bonding the partition wall 628 and the second film 64 is suppressed. Therefore, a reduction in the compliance of the second common liquid chamber 34 is suppressed. Therefore, the occurrence of crosstalk in which the pressure fluctuation generated in one pressure chamber 364 is propagated to the other pressure chamber 364 via the second common liquid chamber 34 is further suppressed.

C. Third Embodiment

Figure 7:
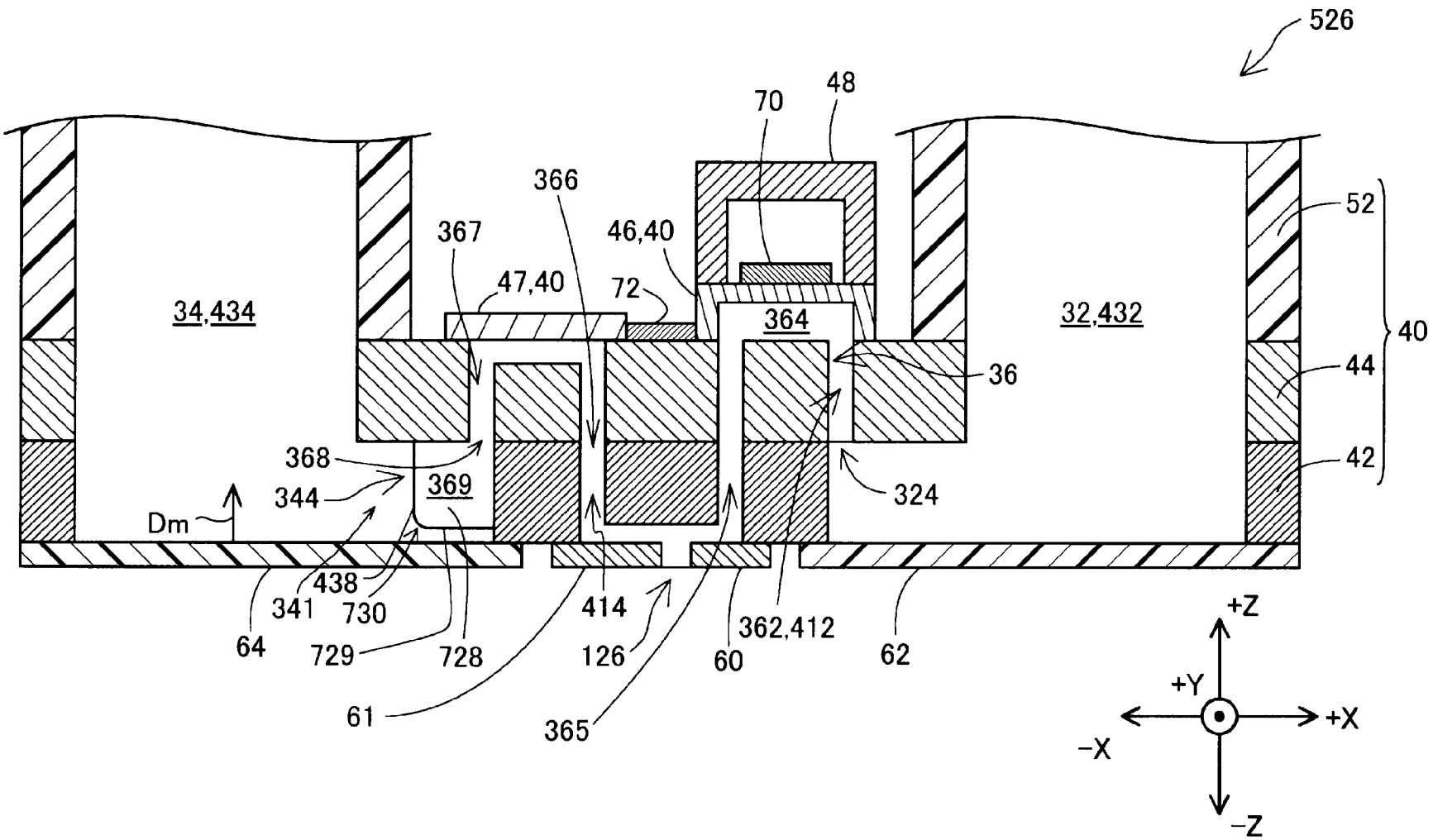
FIG. 7 is a schematic sectional view of a liquid ejecting head according to a third embodiment.

FIG. 7 is a schematic sectional view of a liquid ejecting head 526 according to a third embodiment. The liquid ejecting head 526 according to the third embodiment is different from the liquid ejecting head 26 according to the first embodiment and the liquid ejecting head 226 according to the second embodiment in terms of a structure of a partition wall 728 that forms the outlet flow channel 369. Hereinafter, the same configurations as those according to the first embodiment are designated by the same reference numerals, and detailed description thereof will be omitted.

Similar to the second embodiment, in the liquid ejecting head 526, a plurality of the partition walls 728 and the second film 64 are separated from each other. Accordingly, bonding between the partition wall 728 and the second film 64 is suppressed. Therefore, a reduction in the movable range of the second film 64 by bonding the partition wall 728 and the second film 64 is suppressed. Therefore, a reduction in the compliance of the second common liquid chamber 34 is suppressed.

The partition wall 728 has a rounded shape at a corner portion 730 where a bottom surface 729 on the −Z direction side and a surface that forms the outlet portion 344 and defines a side surface 438 of the second common liquid chamber 34. Accordingly, sharpening of the corner portion 730 can be suppressed. Here, the second film 64 may be bent in a bending direction dm illustrated in FIG. 7. When the second film 64 is bent in the bending direction dm, the corner portion 730 of the partition wall 728 comes into contact with the second film 64. In the partition wall 728, the corner portion 730 is not sharpened. Thus, even when the corner portion 730 and the second film 64 are in contact with each other, damage of the second film 64 due to contact with the partition wall 728 can be suppressed. The shape of the corner portion 730 is not limited to the rounded shape, and may have a non-pointed shape having a tapered shape.

D. Other Embodiment

D1. First Other Embodiment

In the above embodiment, the outlet flow channel 369 is provided in each coupling port 368. However, the present disclosure is not limited thereto. For example, one outlet flow channel 369 may be provided for a plurality of the coupling ports 368. In this case, all the plurality of partition walls 428, 528, and 728 may not be provided between the two adjacent coupling ports 368. When one outlet flow channel 369 is provided for the plurality of coupling ports 368, one individual flow channel 36 includes a plurality of flow channels coupled to one outlet flow channel 369, specifically, a series of flow channels from the first flow channel 362 to the coupling flow channel 367. Further, the partition walls 428, 528, and 728 do not have to be plural, and may be only one. Even in this case, the flow-channel cross-sectional area of the outlet flow channel 369 can be smaller than that when the partition walls 428, 528, and 728 are not provided.

Figure 8:
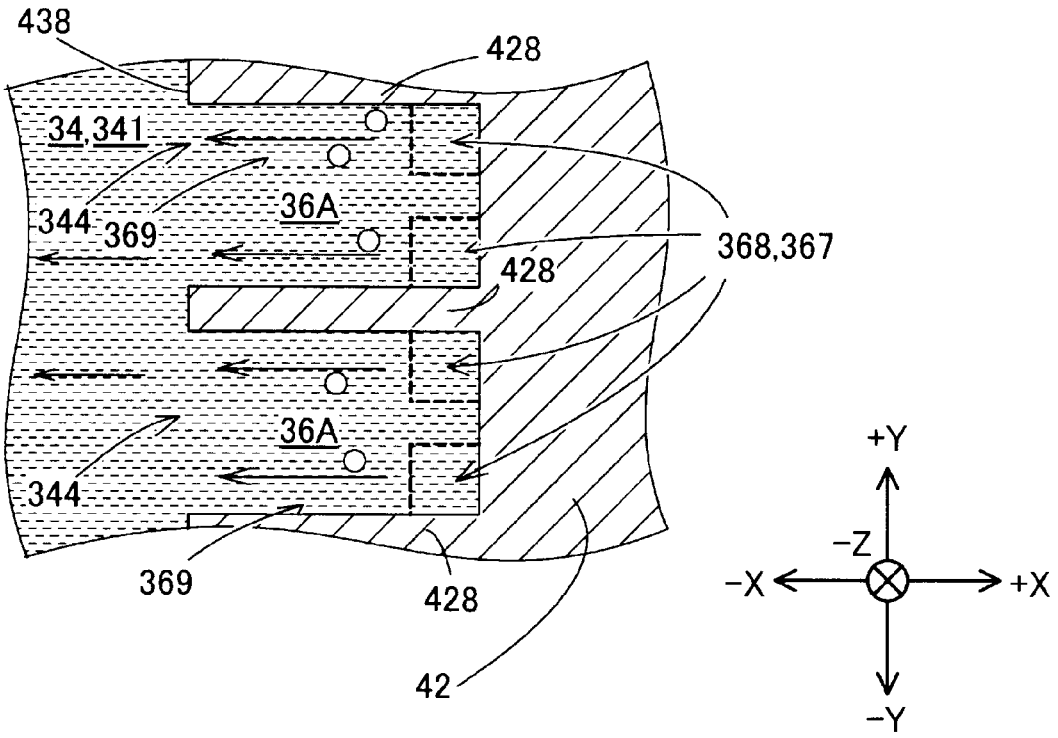
FIG. 8 is a diagram illustrating an example of an individual flow channel in another first embodiment.

FIG. 8 is a diagram illustrating an example of an individual flow channel 36A according to another first embodiment. The individual flow channel 36A has one outlet flow channel 369 and two coupling ports 368 coupled to the one outlet flow channel 369. In this case, the individual flow channel 36A includes two flow channels coupled through the two coupling ports 368 and extending from the first flow channel 362 to the coupling flow channel 367. That is, the individual flow channel 36A has two pressure chambers 364. The two pressure chambers 364 communicate with different nozzles 126, respectively.

D2. Second Other Embodiment

Figure 9:
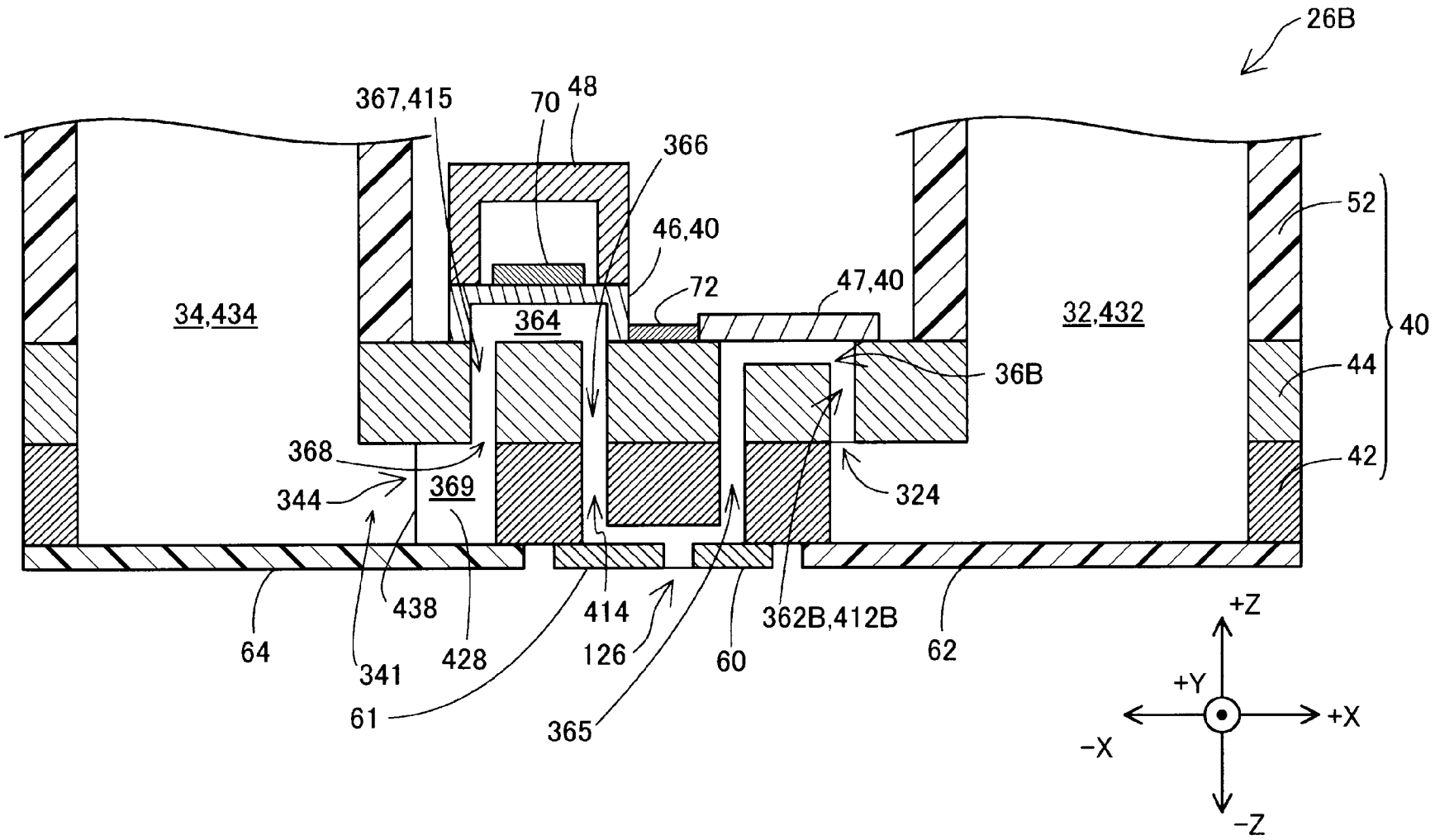
FIG. 9 is a schematic view illustrating an example of a liquid ejecting head according to another second embodiment.

FIG. 9 is a schematic view illustrating an example of a liquid ejecting head 26B according to another second embodiment. The flow channel structure of the individual flow channels 36 and 36A is not limited to that according to the above embodiments. For example, as illustrated in FIG. 9, in the individual flow channel 36B, the pressure chamber 364 may be provided downstream of the nozzle 126. In this case, it is preferable that the cross-sectional area of a first through-hole 412B that forms a first flow channel 362B is smaller than the cross-sectional area of a third through-hole 415 that forms the coupling flow channel 367. In this case, the liquid can be less likely to flow in the first flow channel 362B formed by the first through-hole 412B than in the coupling flow channel 367 formed by the third through-hole 415. Accordingly, the pressure fluctuation in the pressure chamber 364 is efficiently propagated to the nozzle 126 coupled to the individual flow channel 36B between the pressure chamber 364 and the first flow channel 362. Therefore, the liquid can be efficiently ejected from the nozzle 126.

D3. Third Other Embodiment

In the above embodiment, the flow channel resistance of a flow channel of the individual flow channel 36 between the first common liquid chamber 32 and the nozzle 126 is the same as the flow channel resistance of a flow channel of the individual flow channel 36 between the second common liquid chamber 34 and the nozzle 126. However, the present disclosure is not limited thereto. For example, the flow channel resistance of the flow channel between the first common liquid chamber 32 and the nozzle 126 may be smaller or larger than the flow channel resistance of the flow channel between the second common liquid chamber 34 and the nozzle 126.

D4. Fourth Other Embodiment

In the above embodiment, the coupling flow channel 367 extends to be perpendicular to the nozzle surface 61. However, the present disclosure is not limited thereto. For example, the coupling flow channel 367 may extend in a direction other than a vertical direction that intersects the nozzle surface 61.

D5. Fifth Other Embodiment

In the above embodiment. an opening of the outlet portion 344 faces the −X direction that is a direction perpendicular to the Y direction that is the arrangement direction of the individual flow channels 36 among the nozzle surface 61. However, the present disclosure is not limited thereto. The opening of the outlet portion 344 may extend in a direction other than the vertical direction intersecting the Y direction that is the arrangement direction of the individual flow channels 36 among the nozzle surface 61.

D6. Sixth Other Embodiment

In the above embodiment, the first common liquid chamber 32 does not have a wall provided between the first common liquid chamber 32 and the plurality of inlet portions 324. However, the present disclosure is not limited thereto. For example, the first common liquid chamber 32 may have an inlet wall provided between the first common liquid chamber 32 and the plurality of inlet portions 324. In this case, it is preferable that the dimension of the inlet wall c the first common liquid chamber 32 and the plurality of inlet portions 324 in the Z direction that is a direction perpendicular to the nozzle surface 61 is smaller than the dimension of the partition walls 428, 528, and 728 in the Z direction. In this case, the bubbles are easy to block the inlet portions 324, and the bubbles blocking the inlet portions 324 smoothly flow into the inlet portions 324 due to drag. In the above embodiment, the dimension of the wall provided between the first common liquid chamber 32 and the plurality of inlet portions 324 in the Z direction is zero. Therefore, the dimension of the wall provided between the first common liquid chamber 32 and the plurality of inlet portions 324 in the Z direction that is perpendicular to the nozzle surface 61 is smaller than the dimension of the partition walls 428, 528, and 728 in the Z direction. Even when the dimension of the inlet wall in the Z direction is smaller than the dimension of the partition walls 428, 528, and 728 in the Z direction, if the cross-sectional area of the through-hole 412 of the first flow channel 362 is smaller than the cross-sectional area of the second through-hole 414 of the coupling flow channel 367, the flow channel resistance of the flow channel between the first common liquid chamber 32 and the nozzle 126 and the flow channel resistance of the flow channel between the second common liquid chamber 34 and the nozzle 126 may be the same.

D7. Seventh Other Embodiment

In the above embodiment, the second film 64 is used as a member defining the bottom surface of the second common liquid chamber 34. However, the present disclosure is not limited thereto. For example, the member defining the bottom surface of the second common liquid chamber 34 may be a member that does not have flexibility. In this case, the compliance of the second common liquid chamber 34 may be improved by a property other than the flexibility of the bottom surface of the second common liquid chamber 34. For example, the compliance may be improved by an opening provided in the second common liquid chamber 34, specifically, for example, the size and the position of the discharge port 342. Further, a flexible member may be used at a position other than the bottom surface of the second common liquid chamber 34.

The first to seventh other embodiments have the same effect as the first to third embodiments in that the first to seventh other embodiments have the same configuration as the first to third embodiments.

D8. Eighth Other Embodiment

The present disclosure is not limited to an ink jet printer and an ink tank for supplying an ink to the ink jet printer, and can be applied to a predetermined liquid ejecting apparatus that ejects various liquids including the ink and a liquid tank that stores the liquids. For example, the present disclosure can be applied to the following various liquid ejecting apparatuses and the following liquid storage containers thereof.

(1) An image recording apparatus such as a facsimile machine,
(2) A color material ejecting apparatus used for manufacturing a color filter for an image display device such as a liquid crystal display,
(3) An electrode material ejecting apparatus used for forming an electrode of an organic electro luminescence (EL) display, a surface light emission display (a field emission display, FED), and the like,
(4) A liquid ejecting apparatus that ejects a liquid containing a bio-organic material used for manufacturing a biochip,
(5) A sample ejecting apparatus as a precision pipette,
(6) A lubricating oil ejecting apparatus,
(7) A resin liquid ejecting apparatus,
(8) A liquid ejecting apparatus that ejects a lubricating oil to a precision machine such as a timepiece and a camera using a pinpoint,
(9) A liquid ejecting apparatus that ejects a transparent resin liquid such as an ultraviolet curable resin liquid onto a substrate in order to form a micro hemispherical lens (optical lens) used for an optical communication element or the like,
(10) A liquid ejecting apparatus that ejects an acidic or alkaline etching solution for etching a substrate or the like, and
(11) A liquid ejecting apparatus including a liquid ejecting head that ejects the small amount of other predetermined liquid droplets.

The "liquid droplets" refer to a state of the liquid ejected from the liquid ejecting apparatus, which includes a particle shape, a tear shape, and a shape obtained by pulling a tail in a thread shape. Further, the "liquid" herein may be any material that can be ejected by the liquid ejecting apparatus. For example, the "liquid" may be a material in a state in which a substance is in a liquid phase, and also includes a liquid material such as a material in a liquid state having high or low viscosity, sol, gel water, other inorganic solvents, organic solvents, solutions, liquid resins, and liquid metals (metallic melts). Further, the "liquid" includes not only a liquid as one state of a substance but also a liquid in which particles of a functional material made of a solid such as a pigment or metal particles are dissolved, dispersed, or mixed in a solvent. Further, representative examples of the liquid include the ink, the liquid crystal, and the like as described in the above embodiment. Here, the ink includes various liquid compositions such as general water-based ink, oil-based ink, and gel ink.

The present disclosure is not limited to the above-described embodiment, and can be realized with various configurations without departing from the spirit of the present disclosure. For example, the technical features of the embodiments corresponding to the technical features in each aspect described in the summary of the present disclosure can be appropriately replaced or combined in order to solve some or the entirety of the above-described problems or achieve some or the entirety of the above-described effects. Further, when the technical features are not described as essential in the present specification, the technical features can be deleted as appropriate.

(1) According to an aspect of the present disclosure, a liquid ejecting head is provided. This liquid ejecting head includes: a nozzle plate provided with a nozzle for ejecting a liquid; a flow channel forming substrate which is stacked on the nozzle plate and has a plurality of individual flow channels each including a pressure chamber communicating with the nozzle and arranged in an arrangement direction that is one of in-plane directions of the nozzle plate, a first common liquid chamber coupled to the plurality of individual flow channels, and a second common liquid chamber coupled to the plurality of individual flow channels and coupled to the first common liquid chamber via the plurality of individual flow channels; and a pressure generating element that causes a pressure change in the liquid in the pressure chamber, in which in a vertical direction perpendicular to an in-plane direction of the nozzle plate, when a side of the flow channel forming substrate with respect to the nozzle plate is set as one side and a side of the nozzle plate with respect to the flow channel forming substrate is set as another side, each of the plurality of individual flow channels has an outlet flow channel coupled to the second common liquid chamber and extending in the in-plane direction and a coupling flow channel having a coupling port coupled to the outlet flow channel, the coupling flow channel extends from the one side to the other side toward the coupling port, the outlet flow channel has an outlet portion through which the liquid flows into the second common liquid chamber and which faces the in-plane direction, the second common liquid chamber has an introduction flow channel which is coupled to the outlet portion and through which the liquid flows along the in-plane direction, and the flow channel forming substrate has a partition wall which is disposed between two of the outlet flow channels adjacent to each other and which partitions the outlet flow channel. According to the liquid ejecting head of this aspect, a difference between a direction in which the liquid circulates in the second common liquid chamber and a direction of an outlet portion can be reduced. Further, as the wall that partitions the outlet flow channel is provided, the flow-channel cross-sectional area is reduced as compared to a case where the wall is not provided. Accordingly, the flow rate of the liquid in the outlet flow channel increases. Therefore, when the bubbles together with the liquid flow into the individual flow channel, movement of the bubbles flowing from the coupling port into the outlet flow channel becomes smooth. Therefore, occurrence of the bubbles caught at the coupling port can be suppressed.

(2) In the liquid ejecting head according to the above aspect, the second common liquid chamber may include an opening portion that is formed at the flow channel forming substrate and is open toward the other side, and a flexible member that is fixed to the flow channel forming substrate on the other side of the flow channel forming substrate and covers the opening portion. According to the liquid ejecting head of this aspect, since a member that forms the second common liquid chamber includes the flexible member, the compliance of the second common liquid chamber is high. Therefore, occurrence of crosstalk in which a pressure fluctuation occurring in one pressure chamber is propagated to the other pressure chamber via the second common liquid chamber is suppressed.

(3) In the liquid ejecting head according to the above aspect, the partition wall and the flexible member may be separated from each other. According to the liquid ejecting head of this aspect, when the flow channel forming substrate and the flexible member are bonded to each other using an adhesive, adhesion of the adhesive to the wall while the adhesive flows in the partition wall side can be suppressed. Therefore, adhesion between the partition wall and the flexible member can be suppressed.

(4) In the liquid ejecting head according to the above aspect, the partition wall may have a tapered shape or a rounded shape at a corner portion where a surface on the other side and a surface on a side of the outlet portion intersect each other. According to the liquid ejecting head of this aspect, even when the partition wall and the flexible member are in contact with each other, damage of the flexible member due to contact with the partition wall can be suppressed.

(5) In the liquid ejecting head according to the above aspect, the flow channel forming substrate may have a first through-hole that forms a flow channel of the individual flow channel between the first common liquid chamber and the pressure chamber, and a second through-hole that forms a flow channel of the individual flow channel between the second common liquid chamber and the pressure chamber, the nozzle may be provided between the first through-hole and the second through-hole in a flow channel direction of the individual flow channel, and a flow-channel cross-sectional area of the first through-hole may be smaller than a flow-channel cross-sectional area of the second through-hole. According to the liquid ejecting head of this aspect, the liquid can be efficiently ejected from the nozzle by the pressure fluctuation of the pressure chamber.

(6) In the liquid ejecting head according to the above aspect, in the individual flow channel, a flow channel resistance between the first common liquid chamber and the nozzle may be identical with a flow channel resistance between the second common liquid chamber and the nozzle. According to the liquid ejecting head of this aspect, the pressure difference between the first common liquid chamber and the second common liquid chamber can be reduced. Accordingly, adjustment of the meniscus position in the nozzle is facilitated.

(7) In the liquid ejecting head according to the aspect, the size of the partition wall in the vertical direction may be smaller than the size of an inlet wall in the vertical direction, the inlet wall being provided between a plurality of inlet portions coupling the plurality of individual flow channels and the first common liquid chamber. According to the liquid ejecting head of this aspect, catching of the bubbles at the inlet portion coupling the individual flow channel and the first common liquid chamber can be suppressed.

The present disclosure can be also be realized in various forms other than the liquid ejecting head. For example, the present disclosure can be realized in the form of a liquid ejecting apparatus including the liquid ejecting head according to the above aspect and a method of manufacturing the liquid ejecting apparatus.

What is claimed is:

1. A liquid ejecting head comprising:

a nozzle plate provided with a nozzle for ejecting a liquid;

a flow channel forming substrate which is stacked on the nozzle plate and has a plurality of individual flow channels each including a pressure chamber communicating with the nozzle and arranged in an arrangement direction that is one of in-plane directions of the nozzle plate, a first common liquid chamber coupled to the plurality of individual flow channels, and a second common liquid chamber coupled to the plurality of individual flow channels and coupled to the first common liquid chamber via the plurality of individual flow channels; and a pressure generating element that causes a pressure change in the liquid in the pressure chamber, wherein in a vertical direction perpendicular to an in-plane direction of the nozzle plate, when a side of the flow channel forming substrate with respect to the nozzle plate is set as one side and a side of the nozzle plate with respect to the flow channel forming substrate is set as another side, each of the plurality of individual flow channels has an outlet flow channel coupled to the second common liquid chamber and extending in the in-plane direction and a coupling flow channel having a coupling port coupled to the outlet flow channel, the coupling flow channel extends from the one side to the other side toward the coupling port, the outlet flow channel has an outlet portion through which the liquid flows into the second common liquid chamber and which faces the in-plane direction, the second common liquid chamber has an introduction flow channel which is coupled to the outlet portion and through which the liquid flows along the in-plane direction, and the flow channel forming substrate has a partition wall which is disposed between two of the outlet flow channels adjacent to each other and which partitions the outlet flow channel.

2. The liquid ejecting head according to claim 1, wherein the second common liquid chamber includes an opening portion that is formed at the flow channel forming substrate and is open toward the other side, and a flexible member that is fixed to the flow channel forming substrate on the other side of the flow channel forming substrate and covers the opening portion.

3. The liquid ejecting head according to claim 2, wherein the partition wall and the flexible member are separated from each other.

4. The liquid ejecting head according to claim 2, wherein the partition wall has a tapered shape or a rounded shape at a corner portion where a surface on the other side and a surface on a side of the outlet portion intersect each other.

5. The liquid ejecting head according to claim 1, wherein the flow channel forming substrate has a first through-hole that forms a flow channel of the individual flow channel between the first common liquid chamber and the pressure chamber, and a second through-hole that forms a flow channel of the individual flow channel between the second common liquid chamber and the pressure chamber, the nozzle is provided between the first through-hole and the second through-hole in a flow channel direction of the individual flow channel, and a flow-channel cross-sectional area of the first through-hole is smaller than a flow-channel cross-sectional area of the second through-hole.

6. The liquid ejecting head according to claim 1, wherein in the individual flow channel, a flow channel resistance between the first common liquid chamber and the nozzle is identical with a flow channel resistance between the second common liquid chamber and the nozzle.

7. The liquid ejecting head according to claim 6, wherein a size of the partition wall in the vertical direction is smaller than a size of an inlet wall in the vertical direction, the inlet wall being provided between a plurality of inlet portions coupling the plurality of individual flow channels and the first common liquid chamber.

8. A liquid ejecting apparatus comprising:

the liquid ejecting head according to claim 1;

a liquid storage container that stores a liquid supplied to the liquid ejecting head; and a pump that circulates the liquid between the liquid ejecting head and the liquid storage container.

* * * * *